US005215879A

United States Patent [19]

Suzuki et al.

[11] Patent Number: 5,215,879

[45] Date of Patent: Jun. 1, 1993

[54] PROCESS FOR PREPARING A SILVER HALIDE EMULSION

[75] Inventors: Tetuya Suzuki; Shin-ichi Yamamoto; Harumi Asakawa; Toshihiko Yagi; Noriki Tachibana, all of Hino, Japan

[73] Assignee: Konica Corporation, Tokyo, Japan

[21] Appl. No.: 833,550

[22] Filed: Feb. 10, 1992

[30] Foreign Application Priority Data

Feb. 16, 1991 [JP] Japan ..... 3-022438

[51] Int. Cl.[5] ..... G03C 1/005; G03C 1/04

[52] U.S. Cl. ..... 430/569; 430/567; 430/627

[58] Field of Search ..... 430/567, 569, 627

[56] References Cited

U.S. PATENT DOCUMENTS

| | | | |
|---|---|---|---|
| 3,799,781 | 3/1974 | Fitzgerald | 430/569 |
| 4,131,471 | 12/1978 | Fitzgerald | 430/569 |
| 4,152,161 | 5/1979 | Idel et al. | 430/569 |
| 4,386,156 | 5/1983 | Mignot | 430/567 |
| 4,713,323 | 12/1987 | Maskasky | 430/569 |
| 4,798,775 | 1/1989 | Yagi et al. | 430/569 |

*Primary Examiner*—Charles L. Bowers, Jr.
*Assistant Examiner*—Mark F. Huff
*Attorney, Agent, or Firm*—Jordan B. Bierman

[57] ABSTRACT

A silver halide photographic emulsion containing silver halide twinned-crystal grains is prepared by the steps of (a) forming silver halide nuclear grains by mixing a water soluble silver salt and a water soluble halide, (b) forming silver halide seed-emulsion grains by carrying out ripening of the nuclear grains formed in (a), and (c) growing the seed-emulsion grains, wherein a water soluble polymer is introduced by (b), having the repetition unit represented by the following formula [P] in an amount of 10 to 100 mol % per each polymer molecule:

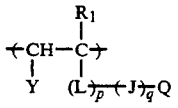

formula [P]

9 Claims, No Drawings

PROCESS FOR PREPARING A SILVER HALIDE EMULSION

FIELD OF THE INVENTION

This invention relates to a process for preparing a silver halide emulsion and particularly to a process for preparing a monodisperse type twinned-crystal silver halide emulsion having a substantially small grain size and a substantially high aspect ratio.

BACKGROUND OF THE INVENTION

In recent years, the improvements of saving silver amounts used in silver halide photographic light sensitive materials (hereinafter referred to as light sensitive materials) have been rapidly progressed so as to make image quality higher and to save resources. With the purpose of satisfying the requirements for the above-mentioned improvements, a variety of studies on how to make silver halide grains smaller in size, how to improve aspect ratios higher and how to use monodisperse type twinned-crystals have been made from the viewpoints of silver halide emulsion preparation processes.

The techniques concerning silver halide grains having high aspect ratios are disclosed in Japanese Patent Publication Open to Public Inspection (hereinafter referred to as "JP OPI Publication") Nos. 58-113926/1983, 58-113927/1983, 58-113928/1983 and 62-163048/1987. The silver halide grains disclosed in the above-given patents are the tabular-shaped grains having an aspect ratio of not lower than 8.

When a twinned-crystal grain having two or more parallel twin planes is projected from the direction vertical to the twinned-crystal faces, the term, 'aspect ratio', herein stated can be expressed by a ratio of a circular-equivalent grain diameter to a distance (i.e., a thickness) between the two parallel outer-surfaces of the grain; the circular-equivalent diameter is obtained by converting the area of the grain into a circular area.

When a silver halide grain can have a high aspect ratio, the following advantages can be enjoyed. The surface area per volume can be widened so that sensitizing dyes can be adsorbed more to the surface of the silver halide grain, as compared to the so-called regular-crystal silver halide grains such as those of a octahedron, tetradecahedron or hexahedron and, particularly in an X-ray light sensitive material, the light-absorption coefficient of a sensitizing dye is larger than the indirect-transition light- absorption coefficient of the X-ray light sensitive material so that the cross-over light, that is a characteristic of X-ray light sensitive materials, can remarkably be so reduced as to provide a higher sharpness.

In order to make an image-quality higher and a silver amount used smaller in a light sensitive material, it is required to make silver halide grains smaller in grain size. The term, 'a grain size', stated herein means a diameter obtained when the projective image area of a grain is converted into a circular area having the same area as that of the projective image. In the above-described process for preparing the grains, any silver halide grains each having a small grain-size and a high monodispersibility could not be prepared, though those having a high aspect ratio could be prepared.

Heretofore, there have been the patents disclosing monodisperse type twinned-crystal emulsions, such as JP OPI Publication Nos. 61-6643/1986 and 61-14636/1986. These patents disclose the techniques for preparing monodisperse type globular-shaped twinned-crystal emulsions prepared by applying an Ostwald ripening treatment thereto after producing the nuclei thereof and, serving the resulting emulsion as the seed emulsion, the seed emulsion is grown further, so that the monodisperse type twinned-crystal emulsion can be prepared. As compared to a polydisperse type emulsion mixed therein large-sized and small-sized grains together, the resulting monodisperse type twinned-crystal emulsion has such an advantage that is readily capable of applying an optimum chemical sensitization.

When making use of these seed emulsion, however, any silver halide grains having a small-size and a high aspect ratio could not be prepared, though highly monodispersed silver halide grains could be prepared.

Besides the above-described process for preparing the emulsions, on the other hand, there have been some similar techniques such as those disclosed in, for example, JP OPI Publication Nos. 1-158426/1989, 1-213637/1989 and 2-838/1990, in which a monodispersed twinned-crystal emulsion is prepared by providing an Ostwald ripening step after producing the nuclei thereof. In these similar techniques, a low molecular-weight gelatin is used when the nuclei is produced. However, such a low molecular-weight gelatin is non-advantageous as a protective colloid formed therewith will cause grain coagulation and sizes of the grains may seriously varied by a coalescence phenomenon produced between the grains so that the production stability may be disturbed thereby. In addition, the gelatin has another defect that the cost thereof is higher than that of the gelatin commonly used in preparing a silver halide photographic emulsion.

Example 1 given in JP OPI Publication No. 2-166442/1990 discloses a technique for producing tabular-shaped grains, in which a reaction vessel and a mixing vessel are so provided that silver halide fine-grains are produced by making use of a low molecular-weight gelatin and a dispersion medium that is a synthetic macro-molecular compound in the mixing vessel and, on the other hand, a twinned-crystal seed emulsion is dissolved in advance with gelatin in the reaction vessel and thereto the silver halide fine-grains are added from the mixing vessel so as to dissolve the fine-grains, so that the seed emulsion is grown up. However, this preparation process is to make smaller the grain sizes of the silver halide grains so that the grains may readily be dissolved, but not to make smaller the grain sizes of the resulting tabular-shaped grains.

Example 1 given in JP OPI Publication No. 2-28638/1990 discloses a technique in which a small grain sized, high aspect ratio, twinned-crystal silver halide emulsion is prepared in a ripening treatment carried out by raising a temperature to 65° C. after producing the nuclei thereof at 30° C. so that an average grain-size of 0.52 μm and an average aspect ratio of 9.5 can be obtained. However, the resulting emulsion has a high variation-coefficient such as 30%.

The present inventors have tried to carry out an Ostwald ripening treatment under the presence of a silver halide solvent at a temperature higher than the temperature of producing the nuclei as disclosed in the above-given JP OPI Publications. However, the same monodisperse type twinned-crystal emulsion as that disclosed in JP OPI Publication No. 61-6643/1986 could not be prepared.

SUMMARY OF THE INVENTION

It is an object of the invention to provide a process for preparing a monodispersed twinned-crystal silver halide emulsion having a small grain-size and a high aspect-ratio and particularly to provide a process for preparing a silver halide seed emulsion applicable to prepare the above-described emulsion without making use of any low molecular-weight gelatin.

Another object of the invention is to provide a process for preparing a silver halide emulsion capable of making both of sensitivity and image-sharpness higher and improving graininess.

The above-mentioned objects of the invention can be achieved in a process for preparing a silver halide emulsion mainly comprising twinned-crystals in which the following processing steps are carried out in order, namely, a seed-emulsion preparation step comprising (a) a step for forming the nuclei of the seeds and (b) Ostwald-ripening, and (c) a step for growing the seed-emulsion grains formed in (b); wherein a water-soluble polymer other than gelatin is made present in the steps following the above-mentioned step for forming the nuclei.

DETAILED DESCRIPTION OF THE INVENTION

It is preferred that the above-described seed emulsion is a monodisperse type twinned-crystal emulsion mainly comprising {100} faces and further that a water-soluble polymer other than gelatin is made present in at least an Ostwald ripening step, because the effects of the invention can be displayed.

In the invention, the term, a 'twinned-crystal', means a silver halide crystal having one or more twin planes in a single grain, and the classification of the twinned-crystals are detailed in Klein and Moisar's report, "Photographische Korrespondenz", Vol.99, p.99 and ibid., Vol.100, p.57. In a twinned-crystal, two or more twinned-crystal faces may be either in parallel or not in parallel to each other.

The silver halide emulsion grains of the invention are to have, desirably, twinned-crystal faces mainly comprising not less than two parallel planes, more desirably, an even number of the planes and, preferably, two twin planes and aspect ratios mainly comprising not less than two. In the invention, the expression, "—be mainly comprised of twinned-crystals each having not less than two parallel twin planes—", means that the numbers of the twinned-crystal grains each having not less than two parallel twin planes are not less than 50%, desirably not less than 60% and preferably not less than 70% of a total of the grain in number.

The twinned-crystals relating to the invention are preferable to comprise {111} faces, {100} faces or both of the faces.

In the twinned-crystal grains each having not less than two parallel twin planes, aspect ratio is defined as the ratio of the diameter of a circle, whose area is equivalent to a grain area obtained when the grain is projected from the direction vertical to the twin planes thereof, to a distance (that is the grain thickness) between the two outer surfaces thereof which are parallel to the twin planes. In the invention, an average aspect ratio of the grains having aspect ratios of not less than 2 is to be within the range of, desirably, 5 to 60, more desirably, 5 to 30 and, preferably, 8 to 20.

In the invention, the expression, '—be mainly comprised of twinned-crystals' means that the proportion of twinned-crystal grains having aspect ratio of not less than 2 to the whole grain is to be not less than 60%, desirably not less than 80% and preferably within the range of 95 to 100%, in number.

In the invention, the term, 'a monodispersed twinned-crystal emulsion', means an emulsion in which the silver halide content within the range of ±20% of the average grain size dm is not less than 70%, desirably not less than 80% and preferably not less than 90% of the whole silver halide content by weight.

The above-mentioned grain-size can be obtained in the following manner. For example, after grains are dispersed on a flat sample table so as not to be overlapped, the grains are magnified 10,000 to 50,000 times by an electron microscope and are then photographed. The diameter or projective area of each printed grain is practically measured. (The numbers of grains subject to measurement are to be not less than 1000 grains selected at random.)

The variation coefficient of grain-size distribution is defined as follows:

$$\text{Variation coefficient (\%)} = \frac{\text{(Standard variation of grains)}}{\text{(Average grain-size)}} \times 100$$

The monodispersed emulsions preferably applicable to the invention have a variation coefficient of not more than 20% and, preferably, not more than 15%.

Herein, the method of measuring the grain-sizes is to be made in accordance with the above-described measurement method, and the average grain-size is to be expressed in terms of an arithmetical mean.

$$\text{An average grain size} = \Sigma d_i n_i / \Sigma n_i$$

In the invention, a seed emulsion, preferably, mainly comprises {100} face.

The expression, 'a seed emulsion mainly comprises {100} face', means that {100} face occupy the outer surfaces of the grains of not less than 50%, desirably not less than 70% and preferably 90%, and the rest of the outer surfaces thereof may be occupied by any faces.

In the silver halide seed emulsions of the invention, the average grain-size thereof is to be within the range of, desirably, 0.03 to 0.30 μm, more desirably 0.05 to 0.25 μm and preferably 0.10 to 0.20 μm.

The silver halide seed emulsions of the invention, (hereinafter referred to simply as 'the seed emulsions of the invention'), are desirable to mainly comprise silver bromide, however, the seed emulsions of the invention may also contain silver iodide and silver chloride, provided that the effects of the invention cannot be spoiled.

In the invention, the term, 'a nucleus forming step', means a step where silver halide nuclei are formed by adding a water-soluble silver salt and a water-soluble halide into a protective colloid solution, and the step is carried out before the silver halide nuclei are maximized in number.

In the invention, the term, 'an Ostwald ripening step', means a step where silver halide nuclei or crystallized grains are reduced in number so that the monodispersibility of a twinned-crystal emulsion may be improved by applying the emulsion to a ripening treatment. It is also allowed to interpose the other growing step between a nuclei forming step and the Ostwald ripening step.

In the process for preparing the seed emulsions of the invention, a nuclei forming temperature is to be not lower than 10° C. or within the range of, desirably, 20° to 80° C. and, preferably, 30° to 60° C.

When forming the nuclei, the pBr of the emulsion is to be within the range of 0.1 to 2.5, desirably 0.6 to 2.0 and, preferably 1.0 to 1.5.

The other preferable requirements for forming the nuclei are as follows.

(1) A gelatin concentration is to be within the range of 0.1 to 10 wt % and preferably 0.5 to 5 wt %;

(2) A pH is to be within the range of 2.0 to 12.0 and preferably 3.0 to 8.0; and (3) A water-soluble silver salt supplying rate in the course of forming nuclei is to be within the range of $1.0\times10^{-3}$ to 3.0 mols/min, desirably $3.0\times10^{-3}$ to $5.0\times10^{-1}$ mols/min and preferably $5.0\times10^{-3}$ to $1.0\times10^{-1}$ mols/min.

In the invention, it was proved that the remarkable effects can be displayed to improve the monodispersibility of twinned-crystal grains and to make the grains smaller in size, when a water-soluble polymer is made present, after carrying out a nuclei formation step and preferably in the course of carrying out an Ostwald ripening step. In particular, it is preferable to make the water-soluble polymer present together with gelatin.

In the invention, the water-soluble polymer may be added in an amount of, desirably, $1\times10^{-4}$ to $3\times10^{2}$ g/mol of silver halide, more desirably, $1\times10^{-3}$ to $1\times10^{2}$ g/mol of silver and, preferably, $1\times10^{-2}$ to 50 g/mol of silver.

The water-soluble polymers applicable to the invention include, for example, synthetic water-soluble polymers and natural water-soluble polymers. Any one of these polymers can preferably be used in the invention. Among them, the synthetic water-soluble polymers include, for example, those having a nonionic group, an anionic group or both of the nonionic and anionic groups in the molecular structure thereof. The nonionic groups include, for example, an ether group, a thioether group, an ethylene oxide group, a hydroxyl group, an amido group and an imidazolyl group. The anionic groups include, for example, a sulfonic acid group or the salts thereof, a carboxylic acid group or the salts thereof and a phosphoric acid group or the salts thereof. The natural water-soluble polymers include, for example, those having a nonionic group, an anionic group or both of the nonionic and anionic groups in the molecular structure thereof.

In either cases of the synthetic or natural water-soluble polymers, the water-soluble polymers having the nonionic group, anionic group or both of the nonionic and anionic groups can preferably be used.

In the invention, the water-soluble polymers are to have a solubility of not less than 0.05 g and, preferably, not less than 0.1 g per 100 g of water at 20° C.

The synthetic water-soluble polymers include, preferablly, those having a repetition unit represented by the following formula [P] within the range of 10 to 100 mol % in each polymer molecule.

Formula [P]

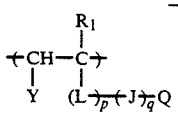

wherein $R_1$ represents a hydrogen atom, an alkyl group including preferably an alkyl group having 1 to 4 carbon atoms which may have a substituent (such as a methyl group, an ethyl group, a propyl group and a butyl group), a halogen atom (such as a chlorine atom), or $-CH_2COOM$, in which M represents a hydrogen atom or a cation; L represents —CONH—, —NHCO—, —COO—, —OCO—, —CO— or —O—; J represents an alkylene group including preferably an alkylene group having 1 to 10 carbon atoms which may have a substituent (such as a methylene group, an ethylene group, a propylene group, a trimethylene group, a butylene group and a hexylene group), an arylene group which may have a substituent (such as a phenylene group) or $-(CH_2CH_2O)_m(CH_2)_n-$ (in which m is an integer of 0 to 40 and n is an integer of 0 to 4); and Q represents either one of the following group;

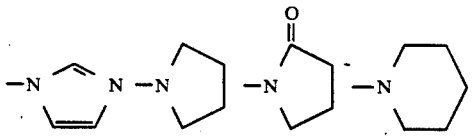

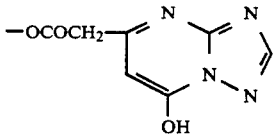

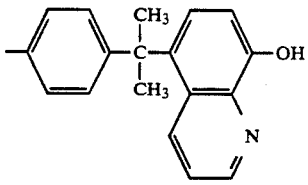

$-N^{\oplus}(R_4)(R_5)(R_6)X^{\ominus}$, $-N(R_7)(R_8)$, —OM, $-NH_2$, $-SO_3M$, $-O-P(=O)(OM)_2$, $-C(=O)R_2$, a hydrogen atom or $R_3$ of which will be detailed later.

Among the above given groups, $-SO_3M$, $-O-P(=O)(OM)_2$ and $-C(=O)R_2$ may desirably be used and among them, $-SO_3M$ may preferably be used.

M represents a hydrogen atom or a cation; $R_2$ represents an alkyl group having 1 to 4 carbon atoms (such as a methyl group, an ethyl group, a propyl group and a butyl group); $R_3$, $R_4$, $R_5$, $R_6$, $R_7$ and $R_8$ represent each an alkyl group having 1 to 20 carbon atoms, which may have a substituent, (such as a methyl group, an ethyl group, a propyl group, a butyl group, a hexyl group, a decyl group and a hexadecyl group); the substituents include, for example, an alkoxy group having 1 to 10 carbon atoms and an alkyl group having 1 to 10 carbon atoms which contains thioether; X represents an anion; Y represents a hydrogen atom or a carboxyl group; p and q are each an integer of 0 or 1.

The water-soluble polymers applicable to the invention include, preferably, a polymer having a nonionic group. The above-mentioned polymers include, for example, those of the polyvinyl alcohol type, polyvinyl pyrrolidone type, polyvinyl imidazole type and polyacrylamide type and the polymers each having a hydroxyquinoline group or a thioether group.

Among the above-given polymers, those of the polyvinyl alcohol type and the polyvinyl pyrrolidone type are preferable.

Next, the concrete examples of the synthetic water-soluble polymers represented by formula [P] will be given below.

| | | Number average molecular weight Mn |
|---|---|---|
| SP-1 | $\leftarrow CH_2-\underset{\underset{OH}{\vert}}{CH}\rightarrow_{100}$ | 8,000 |
| SP-2 | $\leftarrow CH_2-\underset{\underset{NH_2}{\vert}}{CH}\rightarrow_{100}$ | 6,200 |
| SP-3 | $\leftarrow CH_2-\underset{\underset{COOH}{\vert}}{CH}\rightarrow_{100}$ | 4,800 |
| SP-4 | 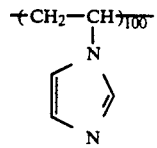 | 4,700 |
| SP-5 | 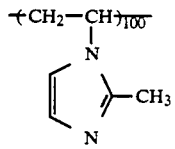 | 6,000 |
| SP-6 | 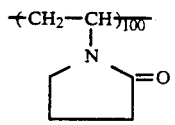 | 2,500 |
| SP-7 | $\leftarrow CH_2-\underset{\underset{CH_2NH_2}{\vert}}{CH}\rightarrow_{100}$ | 11,000 |
| SP-8 | $\leftarrow CH_2-\underset{\underset{CONH_2}{\vert}}{CH}\rightarrow_{100}$ | 15,000 |
| SP-9 | $\leftarrow CH_2-\overset{\overset{CH_3}{\vert}}{\underset{\underset{COOCH_2CH_2SO_3Na}{\vert}}{CH}}\rightarrow_{100}$ | 4,800 |
| SP-10 | 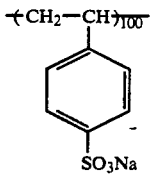 | 7,800 |
| SP-11 | $\leftarrow CH_2-\overset{\overset{CH_3}{\vert}}{\underset{\underset{COO\leftarrow CH_2CH_2O\rightarrow_{74}H}{\vert}}{C}}\rightarrow_{100}$ | 9,000 |
| SP-12 | $\leftarrow CH_2-\underset{\underset{COOCH_2CH_2O\overset{\overset{O}{\Vert}}{P}-ONa}{\vert}}{CH}\rightarrow_{100}$ <br> $\vert$ <br> $ONa$ | 3,200 |

-continued

| | | |
|---|---|---|
| SP-13 | $\leftarrow CH_2-CH\rightarrow_{100}$ (CONH–C(CH$_3$)$_2$–CH$_2$SO$_3$Na) | 9,800 |
| SP-14 | $\leftarrow CH_2-CH\rightarrow_{100}$ (CONH–C(CH$_3$)(C$_6$H$_5$)–CH$_2$SO$_3$Na) | 6,200 |
| SP-15 | $\leftarrow CH_2-CH\rightarrow_{100}$ (OCOCH$_3$) | 4,000 |
| SP-16 | $\leftarrow CH_2-CH\rightarrow_{100}$ (CO–N) | 9,500 |
| SP-17 | $\leftarrow CH_2-C(CH_3)\rightarrow_{100}$ (COOCH$_2$CH$_2$N$^{\oplus}$(C$_2$H$_5$)$_2$–C$_4$H$_9$) Cl$^{\ominus}$ | 8,200 |
| SP-18 | $\leftarrow CH_2-C(CH_3)\rightarrow_{100}$ (COOCH$_2$CH$_2$N(C$_2$H$_5$)$_2$) | 11,000 |
| SP-19 | $\leftarrow CH_2-CH\rightarrow_{100}$ (COOCH$_2$CH$_2$CH$_2$SO$_3$K) | 4,300 |
| SP-20 | $\leftarrow CH_2-CH\rightarrow_{50}$ (OH) $\leftarrow CH_2-CH\rightarrow_{50}$ (OCOCH$_3$) | 9,000 |
| SP-21 | $\leftarrow CH_2-CH\rightarrow_{80}$ (OH) $\leftarrow CH_2-CH\rightarrow_{20}$ (OCOCH$_3$) | 9,000 |
| SP-22 | $\leftarrow CH_2-CH\rightarrow_{50}$ (C$_6$H$_5$) $\leftarrow CH_2-CH\rightarrow_{50}$ (COOH) | 2,600 |
| SP-23 | $\leftarrow CH_2-CH\rightarrow_{50}$ (COOC$_2$H$_5$) $\leftarrow CH_2-CH\rightarrow_{50}$ (COOH) | 11,000 |
| SP-24 | $\leftarrow CH_2-CH\rightarrow_{80}$ (N, N) $\leftarrow CH_2-CH\rightarrow_{20}$ (COOC$_4$H$_9$) | 63,000 |

-continued

| | | |
|---|---|---|
| SP-25 | $\text{-}(CH_2-CH)_{5}\text{-}$ (C6H5) $\text{-}(CH_2-CH)_{95}\text{-}$ ($CONH_2$) | 5,300 |
| SP-26 | $\text{-}(CH_2-CH)_{96}\text{-}$ ($OCOCH_3$) $\text{-}(CH_2-CH)_{5}\text{-}$ (N, N) | 12,000 |
| SP-27 | $\text{-}(CH_2-CH)_{80}\text{-}$ ($CONHC(CH_3)_2CH_2SO_3Na$) $\text{-}(CH_2-CH)_{20}\text{-}$ ($COOC_4H_9$) | 6,800 |
| SP-28 | $\text{-}(CH-CH)_{95}\text{-}$ (COOH, COOH) $\text{-}(CH_2-C(CH_3))_{5}\text{-}$ ($COOCH_2CH_2SO_3K$) | 2,800 |
| SP-29 | $\text{-}(CH-CH)_{95}\text{-}$ (O=C, C=O, O) $\text{-}(CH-CH)_{6}\text{-}$ (COONa, COONa) | 2,600 |
| SP-30 | $\text{-}(CH_2-CH)_{20}\text{-}$ ($COOC_4H_9$) $\text{-}(CH_2-C(CH_3))_{80}\text{-}$ ($COO(CH_2CH_2O)_{10}C_4H_9(t)$) | 33,000 |
| SP-31 | $\text{-}(CH_2-CH)_{50}\text{-}$ ($COOC_2H_5$) $\text{-}(CH_2-CH)_{50}\text{-}$ ($COOCH_2CH_2OP(=O)(ONa)_2$) | 2,100 |
| SP-32 | $\text{-}(CH_2-C(CH_3))_{40}\text{-}$ ($COOC_2H_4SO_3K$) $\text{-}(CH_2-CH)_{60}\text{-}$ ($CONHC(CH_3)_2CH_2SO_3Na$) | 163,000 |
| SP-33 | $\text{-}(CH_2-CH)_{40}\text{-}$ ($COOCH_2CH_2OH$) $\text{-}(CH_2-CH)_{60}\text{-}$ ($CONHC(CH_3)_2CH_2SO_3Na$) | 8,000 |
| SP-34 | $\text{-}(CH_2-C(CH_3))_{60}\text{-}$ ($COO(CH_2CH_2O)_4H$) $\text{-}(CH_2-CH)_{40}\text{-}$ ($COOCH_2CH_2OP(=O)\text{-}(ONa)_2$) | 4,700 |
| SP-35 | $\text{-}(CH_2-C(CH_3))_{70}\text{-}$ ($COO(CH_2CH_2O)_{10}C_4H_9(t)$) $\text{-}(CH_2-CH)_{30}\text{-}$ (COOH) | 5,500 |
| SP-36 | $\text{-}(CH_2-C(CH_3))_{50}\text{-}$ ($COOCH_2CH_2OH$) $\text{-}(CH_2-C(CH_3))_{50}\text{-}$ ($COOCH_2CH_2SO_3Na$) | 11,000 |

-continued

| | | |
|---|---|---|
| SP-37 | $\text{-}(CH_2\text{-}CH)_{30}\text{-}$ (OH) $\text{-}(CH_2\text{-}CH)_{70}\text{-}$ (CONHC(CH$_3$)$_2$CH$_2$SO$_3$Na) | 3,200 |

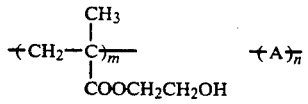

| | m | n | -(A)- | Number average molecular weight Mn |
|---|---|---|---|---|
| SP-38 | 50 | 50 | $\text{-}(CH_2\text{-}CH)\text{-}$ (COOH) | 7,300 |
| SP-39 | 40 | 60 | $\text{-}(CH_2\text{-}C(CH_3))\text{-}$ (COOH) | 2,700 |
| SP-40 | 60 | 40 | $\text{-}(CH_2\text{-}C(CH_3))\text{-}$ ($COOCH_2CH_2SO_3Na$) | 4,800 |
| SP-41 | 50 | 50 | $\text{-}(CH_2\text{-}CH)\text{-}$ ($SO_3Na$) | 11,500 |
| SP-42 | 60 | 40 | $\text{-}(CH_2\text{-}CH)\text{-}$ ($COOCH_2CH_2OP(=O)(ONa)_2$) | 8,700 |
| SP-43 | 40 | 60 | $\text{-}(CH_2\text{-}CH)\text{-}$ (CONHC(CH$_3$)$_2$CH$_2$SO$_3$Na) | 5,300 |
| SP-44 | 50 | 50 | $\text{-}(CH_2\text{-}CH)\text{-}$ (CONHC(CH$_3$)(C$_6$H$_5$)CH$_2$SO$_3$Na) | 7,900 |
| SP-45 | 50 | 50 | $\text{-}(CH_2\text{-}CH)\text{-}$ ($COOCH_2CH_2SO_3Na$) | 4,900 |
| SP-46 | 50 | 50 | $\text{-}(CH\text{-}CH)\text{-}$ (COOH, COOH) | 2,800 |
| SP-47 | $\text{-}(CH_2\text{-}C(CH_3))_{50}\text{-}$ ($COO(CH_2CH_2O)_4H$) | $\text{-}(CH_2\text{-}C(CH_3))_{50}\text{-}$ ($COOCH_2CH_2SO_3Na$) | 6,300 |

-continued

| | | |
|---|---|---|
| SP-48 | $-(CH_2-C(CH_3)(COO(CH_2CH_2O)_4H))_{50}-$ $-(CH_2-CH(C_6H_4-SO_3Na))_{50}-$ | 10,500 |
| SP-49 | $-(CH_2-C(CH_3)(COO(CH_2CH_2O)_8H))_{50}-$ $-(CH_2-CH(C_6H_4-SO_3Na))_{50}-$ | 7,200 |
| SP-50 | $-(CH_2-C(CH_3)(COOCH_2CH_2OH))_{40}-$ $-(CH_2-CH(C_6H_4-SO_3Na))_{30}-$ $-(CH_2-CH(COOC_4H_9))_{30}-$ | 14,300 |
| SP-51 | $-(CH_2-C(CH_3)(COOCH_2CH_2OH))_{10}-$ $-(CH_2-CH(COOCH_2CH_2SO_3Na))_{20}-$ $-(CH_2-CH(COOCH_3))_{70}-$ | 15,600 |
| SP-52 | $-(CH_2-CH(OH))_{98}-$ $-(CH_2-CH(OCOCH_3))_{2}-$ | 22,000 |
| SP-53 | $-(CH_2-CH(OH))_{88}-$ $-(CH_2-CH(OCOCH_3))_{12}-$ | 25,000 |
| SP-54 | $-(CH_2-CH(OH))_{98}-$ $-(CH_2-CH(OCOCH_3))_{2}-$ | 45,000 |
| SP-55 | $-(CH_2-CH(OH))_{88}-$ $-(CH_2-CH(OCOCH_3))_{12}-$ | 49,000 |
| SP-56 | $-(CH_2-CH(OH))_{98}-$ $-(CH_2-CH(OCOCH_3))_{2}-$ | 76,000 |
| SP-57 | $-(CH_2-CH(OH))_{88}-$ $-(CH_2-CH(OCOCH_3))_{12}-$ | 83,000 |
| SP-58 | $-(CH_2-CH(OH))_{98}-$ $-(CH_2-CH(OCOCH_3))_{2}-$ | 108,000 |
| SP-59 | $-(CH_2-CH(OH))_{88}-$ $-(CH_2-CH(OCOCH_3))_{12}-$ | 118,000 |
| SP-60 | $-(CH_2-CH(N\text{-}C_4H_6O))_{100}-$ | 10,000 |

-continued

| | | |
|---|---|---|
| SP-61 | $\leftarrow CH_2-CH\rightarrow_{100}$ (N, =O) | 40,000 |
| SP-62 | $\leftarrow CH_2-CH\rightarrow_{100}$ (N, =O) | 100,000 |
| SP-63 | $\leftarrow CH_2-CH\rightarrow_{35}$ (OH) $\leftarrow CH_2-CH\rightarrow_{75}$ (N, =O) | 60,000 |
| SP-64 | $\leftarrow CH_2-CH\rightarrow_{95}$ ($CONH_2$) $\leftarrow CH_2-CH\rightarrow_{5}$ (N, $-CH_3$, N) | 55,000 |

The synthetic water-soluble polymers of the invention can readily be synthesized in any one of the various methods such as a solution-polymerization method, a block-polymerization method and a suspension-polymerization method.

In the solution-polymerization, for example, a copolymerization reaction is commonly carried out in the following manner. In the presence of a polymerization initiator (such as benzoyl peroxide, azobisisobutylonitrile and ammonium peroxide), a monomer mixture having a suitable concentration (i.e., a mixture thereof commonly having a concentration of not more than 40 wt % and preferably within the range of 10 to 25 wt % to a solvent used therein) is heated up to a suitable temperature (such as within the range of 40° to 120° C. and preferably 50° to 100° C.) in a suitable solvent (such as ethanol, methanol and water). Thereafter, the resulting reacted mixture is poured into a medium without keeping the resulting water-soluble polymers undissolved and the resulting products is precipitated and dried up and then the mixture unreacted is so isolated as to be removed.

The number average molecular weight of the water-soluble polymers of the invention is to be within the range of 1,000 to 1,000,000 and preferably 2,000 to 500,000. The number average molecular weight thereof is obtained in terms of a standard polystyrene by making use of a gel permeation chromatography, Model HLC-802A manufactured by Toyo Soda Co., Ltd.

In the invention, the above-mentioned water-soluble polymers are added in the form of the polymer solutions into an emulsion already treated in a nuclei production step. As for the solvents applicable to the water-soluble polymers, hydrophilic solvents may be used. Among them, it is desirable to use a mixed solution of a hydrophilic organic solvent and water and it is preferable to use water.

The foregoing natural water-soluble polymers are detailed in 'The comprehensive Technical Data of Water-Soluble Macromolecular Water-Dispersion Type Resins' published by Publishing Dept. of Management Development Centre. The natural water-soluble polymers include, preferably, lignin, starch, pullane, cellulose, alginic acid, dextran, dextrin, gua-rubber, gum arabic, glycogen, laminaran, lichenin, nigeran, and the derivatives thereof.

The preferable natural water-soluble polymer derivatives include, for example, those sulfonated, carboxylated, phosphorated, sulfoalkylated, carboxyalkylenated or alkyl-phosphorated and the salts thereof.

In the invention, not less than two kinds of the natural water-soluble polymers may be used in combination.

Among the natural water-soluble polymers, a glucose polymer and the derivatives thereof may preferably be used. Among the glucose polymers and the derivatives thereof glycogen, cellulose, lichenin, dextran and nigeran may desirably be used and, among them, dextran and the derivatives may preferably be used.

As for the water-soluble polymers of the invention, a polymer having a hydrophilic group and a ethylene double-bond in the molecular structure thereof may also be used. For example, these polymers include, desirably, a polymer mainly comprising a compound represented by the following formula [$p_1$], [$p_2$] or [$p_3$].

Herein, the above-mentioned hydrophilic groups include the same as those described of the foregoing synthetic water-soluble polymers.

Formula [$p_1$]

$$\leftarrow CCH{=}CHCOR_1O\rightarrow_{n1} \qquad \leftarrow CCHCH_2COR_1O\rightarrow_{n2}$$

(O, O; O, O; $SO_3M_1$)

wherein $R_1$ represents a divalent organic group; $M_1$ represents a hydrogen atom or a univalent cation; $n_1$ is a proportion within the range of 30 to 95 mol %; and $n_2$ is a proportion within the range of 70 to 5 mol %.

Formula [$p_2$]

$$\leftarrow CH_2CH{=}CHCH_2\rightarrow_{n3}\leftarrow CH_2CH{=}CHCH\rightarrow_{n4}$$

($CHCOOM_2$, $CH_2COOM_3$)

-continued

Formula [p2]

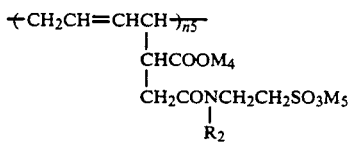

wherein $R_2$ represents a hydrogen atom or an alkyl group; $M_2$, $M_3$, $M_4$ and $M_5$ represent each a hydrogen atom or a univalent cation; and $n_3$ $n_4$ and $n_5$ are the proportion within the range of 30 to 95 mol %, 70 to 0 mol % and 70 to 0 mol %, provided, $n_4+n_5$ is a proportion within the range of 70 to 5 mol %, respectively.

Formula [p3]

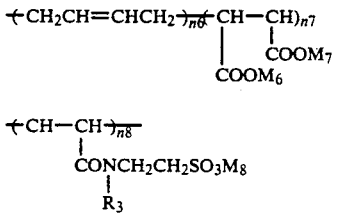

wherein $R_3$ represents a hydrogen atom or an alkyl group; $M_6$, $M_7$, and $M_8$ represent each a hydrogen atom or a univalent cation; $n_6$, $n_7$ and $n_8$ are the proportion within the range of 30 to 70 mol %, 5 to 50 mol % and 70 to 5 mol %, provided, $n_7+n_8$ is a proportion within the range of 70 to 30 mol %, respectively.

Next, formulas [$p_1$], [$p_2$] and [p3] will be detailed below. The divalent organic groups represented by $R_1$ include, for example, the following groups; namely, the divalent residual groups of aliphatic hydrocarbon, such as ethylene, trimethylene, tetramethylene, hexamethylene, propenylene, 3,6-dioxaoctane-1,8-diyl, 2,2-dimethyl trimethylene, propylene and 1,4-cyclohexylene; the divalent residual groups of aliphatic hydrocarbon, which are substituted with a halogen atom, a cyano group, an alkyloxy group or an aryloxy group, such as 1,2-dichlorethylene, 2-chlorotrimethylene, 2-bromotrimethylene, 1-cyanomethyl ethylene, 1-chloromethyl ethylene, 1-methoxymethyl ethylene and 1-phenoxyethylene; the divalent residual groups of aromatic hydrocarbon, such as 1,4-phenylene, 1,3-tolylene, 2-chrolo-1,4 phenylene, 2-cyano-1,4-phenylene and 2-methoxy-1,5-phenylene; the divalent residual groups of aromatic hydrocarbon, which are substituted with a halogen atom, a cyano group or an alkyloxy group; the divalent residual groups of aliphatic hydrocarbon, such as 1,1'-(1,4-phenylene)dimethyl, 2,2'-(2-chloro-1,4-phenylene)diethyl and 2,2'-(2-cyano-1,4-phenylene)-diethyl; or the divalent residual groups of aliphatic hydrocarbon bonded to an aryl group substituted with a halogen atom or a cyano group.

$M_1$, $M_2$, $M_3$, $M_4$ and $M_5$ represent each a hydrogen atom, a univalent cation of an alkali metal such as lithium, sodium and potassium, or an ammonium cation. As for the polymers having each an ethylene double-bond to a hydrophilic group in the molecular structure of the polymer, the compounds represented by formula [$p_1$] may preferably be used.

For the above-mentioned Ostwald ripening treatment, the other preferable conditions are required as follows.

(1) A silver halide solvent required: $10^{-5}$ to 2.0 mols per mol of silver halide;

(2) A temperature required: 15° to 80° C. and preferably 20° to 70° C.;

(3) A pH required: 2 to 13 and preferably 3 to 12;

(4) A gelatin concentration required: 0.1 to 10 wt % and preferably 0.5 to 5 wt %; and (5) A pBr required: 0.5 to 3.0 and preferably 1.2 to 2.0

The silver halide solvents applicable to the Ostwald ripening treatments of the invention include, for example, the following solvents; namely, (a) the thioethers given in U.S. Pat. Nos. 3,271,157, 3,531,289 and 3,574,628, JP OPI Publication Nos. 54-1019/1979 and 54-158917/1979 and Japanese Patent Examined Publication No. 58-30571/1983; (b) the thiourea derivatives given in JP OPI Publication Nos. 53-82408/1978, 55-29829/1980 and 57-77736/1982; (c) the AgX solvents having a thiocarbonyl group interposed between oxygen or sulfur atom and nitrogen atom, given in JP OPI Publication No. 53-144319/1978; (d) the imidazoles given in JP OPI Publication No. 54-100717/1979; (e) sulfites; (f) thiocyanates; (g) ammonia; (h) the ethylenediamines each substituted with a hydroxyalkyl group, given in JP OPI Publication No. 57-196228/1982; (i) the substituted mercaptotetrazoles given in JP OPI Publication No. 57-202531/1982; (j) water-soluble bromides; and (k) the benzoimidazole derivatives given in JP OPI Publication No. 58-54333/1983.

Next, the concrete examples of the above-given silver halide solvents (a) through (k) will be given below.

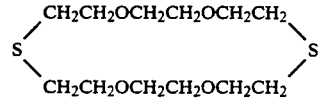

(a)

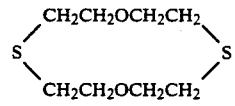

$HOCH_2CH_2SCH_2CH_2SCH_2CH_2OH$

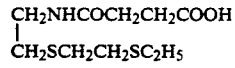

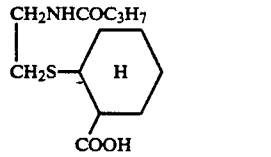

(b)

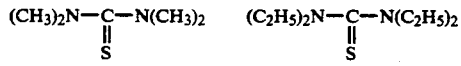

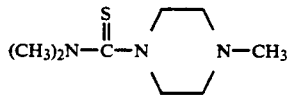

-continued

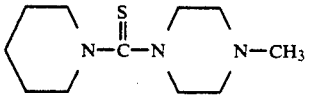

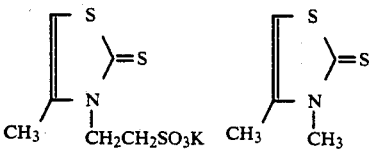

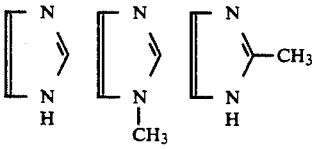

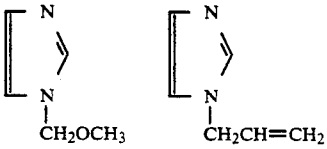

$K_2SO_3$, $Na_2SO_3$ $NH_4SCN$, KSCN $NH_3$ $(HOCH_2CH_2)_2NCH_2CH_2N(CH_2CH_2OH)_2$ $(CH_3CHCH_2)_2NCH_2CH_2N(CH_2CHCH_3)_2$
OH OH $(C_2H_5)_2NCH_2CH_2N(CH_2CH_2OH)_2$ $(C_2H_5CHCH_2)_2NCH_2CH_2N(CH_2CHC_2H_5)_2$
OH OH

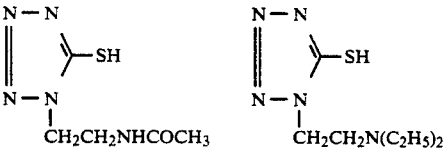

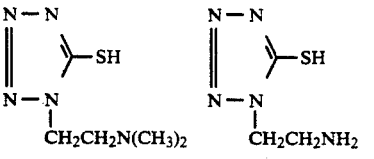

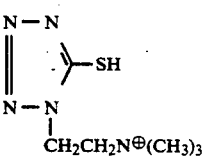

NaBr, $NH_4Br$, KBr

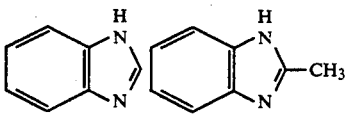

-continued

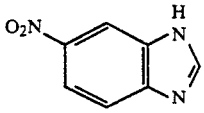

(c) The above-given solvents may be used in combination. The desirable solvents among them include, for example, thioethers, thiocyanates, thioureas, ammonia and bromides. Among them, the preferable solvents include, for example, an combination of ammonia/bromides.

(d) For the purpose of controlling a ripening treatment being carried out in the Ostwald ripening step of the invention, it is allowed to add a water-soluble silver salt.

The foregoing seed emulsion grains of the invention can be enlarged in a growing step. The term, 'a growing step', herein means a step where a silver halide crystal growing element is supplied at a rate within the range of 20 to 100% of a critical growth rate at which new nuclei can be produced, without producing new nuclei nor any Ostwald ripening reaction.

The growing conditions of the above-mentioned growing step of the invention can be satisfied in any one of an acid process, a neutral process and an ammoniacal process. These processes applicable thereto include, for example, the well-known processes detailed in JP OPI Publication Nos. 61-6643/1986, 61-14630/1986, 61-112142/1986, 62-157024/1987, 62-18556/1987, 63-92942/1988, 63-151618/1988, 63-1613451/1988, 63-220238/1988 and 63-311244/1988.

(e)

(f)

(g)

(h) The foregoing crystal growing elements are to be preferably supplied at a rate within the range of 20 to 100% of a critical growing rate at which new nuclei are produced. These elements to be supplied include, for example, any one of the solutions containing a water-soluble silver salt or a halide and the solutions containing a silver halide fine grains.

Any side-products, any excess salts or other unnecessary elements may be removed in an ordinary method such as a flocculation method and a noodle-wash method.

(i)

In a silver halide prepared by making use of the seed emulsion of the invention, the average silver iodide content thereof is to be within the range of, desirably, 0.1 to 45 mol %, more desirably, 0.5 to 25 mol % and, preferably, 1 to 20 mol %.

The silver halide emulsions prepared by making use of the seed emulsion of the invention are each mainly comprise silver iodobromide or silver iodobromochloride and the grains thereof may be of either the surface latent image type or the internal latent image type.

The silver halide emulsions prepared by making use of the seed emulsion of the invention may be subject to a chemical sensitization in an ordinary method and may also be optically sensitized to any desired wavelength region by making use of the dyes well-known as the so-called sensitizing dyes in photographic industry. The above-mentioned sensitizing dyes may be used independently or in combination.

(j) The silver halide emulsions prepared by making use of the seed emulsion of the invention may be added thereto with an antifoggant and a stabilizer.

(k) The silver halide emulsions prepared by making use of the seed emulsion of the invention may be applied to almost all photographic light sensitive materials including, for example, black-and-white photographic light sensitive materials (such as an X-ray light sensitive material, a lithographic light sensitive material and a black-and-white negative film) and color photographic light sensitive materials (such as a color negative film, a color reversal film, a color paper and a color reversal paper). In particular, the emulsions are suitably applied to a high-speed black-and-white light sensitive material.

When the silver halide emulsions prepared by making use of the seed emulsion of the invention is exposed to a medical X-ray radiography, there uses, for example, a fluorescent intensifying screen mainly comprising a fluorescent substance capable of emitting either near ultraviolet rays or visible rays when it is exposed to transmission radiation. It is desired to bring the above-mentioned fluorescent intensifying screen into close contact with the both sides of a light sensitive material coated on the both sides with the emulsions of the invention and to make an exposure.

A well-known additive may be added to the silver halide emulsions prepared by making use of the seed emulsion of the invention and a silver halide photographic light sensitive materials applied thereto with the emulsions.

The additives useful therefor are given in, for example, Research Disclosure Nos. 17643, 18716 and 308119 (hereinafter referred to as, simply, RD17643, RD18716 and RD308119).

The additives are given in the following pages of the above-given RD.

| | [Page and Item in] | | |
|---|---|---|---|
| [Additive] | [RD308119] | [RD17643] | [RD18716] |
| Chemical sensitizer | 996, III-A | 23 | 648 |
| Spectral sensitizer | 996, IV-A-A,B, C,D,H,I,J | 23-24 | 648-9 |
| Super sensitizer | 996, IV-A-E,J | 23-24 | 648-9 |
| Antifoggant | 998, VI | 24-25 | 649 |
| Stabilizer | 998, VI | 24-25 | 649 |

The well-known photographic additives applicable to the invention are also given in the same RDs.

The photographic additives are given in the following pages of the above-given RD.

| | [Page and Item in] | | |
|---|---|---|---|
| [Additive] | [RD308119] | [RD17643] | [RD18716] |
| Color-stain preventive | 1002, VII-I | 25 | 650 |
| Dye-image stabilizer | 1001, VII-J | 25 | |
| Bleacher | 998, V | 24 | |
| UV absorbent | 1003, VIII-C, XIIIC | 25-26 | |
| Light absorbent | 1003, VIII | 25-26 | |
| Light scattering agent | 1003, VIII | | |
| Filter dye | 1003, VIII | 25-26 | |
| Binder | 1003, IX | 26 | 651 |
| Antistatic agent | 1006, XIII | 27 | 650 |
| Hardener | 1004, X | 26 | 651 |
| Plasticizer | 1006, XII | 27 | 650 |
| Lubricant | 1006, XII | 27 | 650 |
| Surfactant · Coating aid | 1005, XI | 26-27 | 650 |
| Matting agent | 1007, XVI | | |
| Developing agent (contained in light sensitive materials) | 1011, XXB | | |

A variety of couplers may be used in the silver halide photographic light sensitive materials prepared by making use of the seed emulsions of the invention. The typical examples of such couplers are also given in the above-mentioned RDs.

The couplers are given in the following pages of the above-given RD.

| | [Page and Item in] | |
|---|---|---|
| [Additive] | [RD308119] | [RD17643] |
| Yellow coupler | 1001, VII-D | VIIC~G |
| Magenta coupler | 1001, VII-D | VIIC~G |
| Cyan coupler | 1001, VII-D | VIIC~G |
| Colored coupler | 1002, VII-G | VIIG |
| DIR coupler | 1001, VII-F | VIIF |
| BAR coupler | 1002, VII-F | |
| Other useful residual group releasing coupler | 1001, VII-F | |
| Alkali-soluble coupler | 1001, VII-E | |

Into the silver halide emulsions prepared in the invention and the light sensitive materials applied with the emulsions, an additive applicable thereto may be added in such as method as the dispersion methods detailed in RD308119, XIV.

In the silver halide emulsions prepared in the invention and the light sensitive materials applied with the emulsions, the supports described in RD17643, p.28, RD18716, pp.647-8 and RD308119, XIX may be used.

To the light sensitive materials prepared by making use of the silver halide emulsions prepared in the emulsion-preparation processes of the invention, the filter layers, interlayers and protective layers each described in RD308119, VII-K may be provided.

In the light sensitive materials prepared by making use of the silver halide emulsions prepared in the emulsion-preparation processes of the invention, a variety of layer arrangements such as an regular layer arrangement, a reverse layer arrangement and a unit layer arrangement may be adopted as described in RD308119. VII-K.

The supports applicable thereto include, for example, a sheet of paper laminated thereon with polyethylene or the like, a polyethylene terephthalate film, a sheet of baryta paper and a cellulose triacetate film.

EXAMPLES The examples of the invention will now be detailed. It is, however, to be understood that the embodiments of the invention shall not be limited thereto.

EXAMPLE 1 (For Comparison))

Preparation of a Comparative Seed Emulsion

A seed emulsion comprising silver bromide was prepared by making use of the following solutions.

| | |
|---|---|
| [$A_1$] | |
| Ossein gelatin | 40 g |
| Potassium bromide | 23.7 g |
| Add water to make | 4000 ml |
| [$B_1$] | |
| Silver nitrate | 600 g |
| Add water to make | 803 ml |
| [$C_1$] | |
| Ossein gelatin | 16.1 g |
| Potassium bromide | 420 g |
| Add water to make | 803 ml |
| [$D_1$] | |
| Aqueous ammonia (in a 28% solution) | 235 ml |

By making use of the apparatus disclosed in JP OPI Publication No. 62-160128/1987, the nozzles each having 6 orifices are so provided as to supply solutions $B_1$ and $C_1$ toward the lower part of the propellers for mixation and agitation, respectively.

Solutions $B_1$ and $C_1$ were added at a addition rate of 62.8 ml/min into solution $A_1$ which was agitated at a high speed of 430 rpm and at 40° C., with a controlled double-jet method. From the point of time 4 min. 46 sec after starting the addition thereof, the addition rate was gradually raised and the final addition rate was kept to be 105 ml/min. The total addition time required was 10 min. 45 sec. The pBr was kept to be 1.3 by adding a suitable amount of a (3.5N) potassium bromide solution.

Four minutes after completing the addition, the agitation was made at 460 rpm and solution $D_1$ was added for 20 seconds while keeping the temperature to be 40° C., so that an Ostwald ripening treatment was carried out for 5 minutes. When the ripening treatment was carried out, the bromine ion concentration was 0.028 mols per liter, the ammonia concentration was 0.63 mols per liter and the pH was 11.7.

Thereafter, the resulting solution was immediately added with acetic acid so as to have a pH of 5.6 and, the ripening treatment was stopped in operation, the resulting solution was desalted and then washed, so that seed emulsion Em-1 could be prepared.

When Em-1 was observed through an electron microscope, it was proved to be comprised of globular-shaped grains having an average grain-size of 0.32 μm and a grain-size variation coefficient of 17%.

Growth of a Comparative Seed Emulsion

In succession to the above, a silver halide emulsion relating to the invention mainly comprising tabular-shaped twinned crystals was prepared by making use of comparative seed emulsion Em-1 and the following three kinds of the solutions.

| | |
|---|---|
| [$A_2$] | |
| Ossein gelatin | 35.1 g |
| Disodium propyleneoxy.polyethylenoxy. disuccinate, (in a 10% methanol solution) | 10 ml |
| Add water to make | 4000 ml |
| [$B_2$] | |
| Ossein gelatin | 117.7 g |
| Potassium bromide | 868.6 g |
| Potassium iodide | 24.9 g |
| Add water to make | 5000 ml |
| [$C_2$] | |
| Silver nitrate | 1167.6 mg |
| Add water to make | 6248 ml |
| Seed emulsion Em-1 | Equivalent to 0.191 mols |

Seed emulsion Em-1 was added into solution $A_2$ which was stirred vigorously at 65° C. and the mixture was dispersed well. The resulting dispersion was then added with solutions $B_2$ and $C_2$ by taking a time for 112 minutes, in a controlled.double-jet method.

While the addition was kept on, the solution being mixed up was kept at a pH of 2.0 with nitric acid and a pAg of 9.0 for all the while. The rates of adding solutions $B_2$ and $C_2$ were controlled so that the adding rates thereof at the time of completing the addition could be 6.4 times linearly increased more than that at the time of starting the addition thereof.

Immediately after completing the above-mentioned addition, the pH of the resulting mixed solution was controlled to have a pH of 6.0 by making use of acetic acid and the solution was subjected to a desalinization by making use of an aqueous solution of Demol (manufactured by Kao-Atlas Corp.) and an aqueous solution of magnesium sulfate so that any excess salts could be removed, and thereby emulsion EM-1 having a pH of 5.85 could be prepared at a pAg of 8.5 and a temperature of 40° C.

When observing the resulting emulsion through an electron microscope, it was proved that the emulsion contained grains having an average grain-size of 1.4 μm, a grain-size variation coefficient of 19% and an average grain-thickness of 0.35 μm, and 86% of the whole grains were occupied by the tabular-shaped grains having an aspect ratio of not less than 2 and that the average aspect ratio of the grains having the aspect ratio of not less than 2 was 4.0.

EXAMPLE 2 (Of The Invention)

Preparation of the Seed Emulsions of the Invention

Seed emulsions of the invention, Em-2 through Em-16 were each prepared in the same manner as in Example 1, except that solutions $B_1$ and $C_1$ were added into solution $A_1$ in a double-jet method and, one minute after completing the addition, water-soluble synthetic polymers SP-1, 19, 20 and 52 through 59 were each added as shown in Table 1.

The water-soluble polymers were added in an prescribed amount of 750 ml in the form of the aqueous solutions thereof.

When the ripening treatments of Em-2 through 16 were completed, the KBr concentration, ammonia concentration and pH thereof were 0.026 mols/liter, 0.63 mols/liter and 11.3, respectively.

The resulting seed emulsions were observed through an electron microscope so as to obtain the average grain-size, the proportion of the seed grains having {100} face, the proportion of the {100} face of the seed grains and the grain-size variation coefficient. The results thereof are shown in Table 1, together with the results obtained from comparative seed emulsion Em-1.

TABLE 1

| Seed emulsion No. | Water-soluble polymer Kind | Water-soluble polymer Amount added (g/mol of Ag) | Average grain-size (μm) | Proportion of seed grain having {100} face (%) | Proportion of {100} face of seed grain (%) | Grain-size variation coefficient (%) |
|---|---|---|---|---|---|---|
| Em-1 | — | — | 0.32 | — | — | 17 |
| Em-2 | SP-1 | 28.3 | 0.13 | 80 | 81 | 13 |
| Em-3 | SP-19 | 28.3 | 0.15 | 91 | 82 | 13 |
| Em-4 | SP-20 | 28.3 | 0.14 | 88 | 83 | 12 |
| Em-5 | SP-52 | 28.3 | 0.13 | 83 | 93 | 12 |
| Em-6 | SP-53 | 28.3 | 0.12 | 82 | 91 | 13 |
| Em-7 | SP-54 | 28.3 | 0.15 | 85 | 92 | 14 |
| Em-8 | SP-55 | 28.3 | 0.14 | 84 | 96 | 15 |

TABLE 1-continued

| Seed emulsion No. | Water-soluble polymer Kind | Amount added (g/mol of Ag) | Average grain-size (μm) | Proportion of seed grain having {100} face (%) | Proportion of {100} face of seed grain (%) | Grain-size variation coefficient (%) |
|---|---|---|---|---|---|---|
| Em-9 | SP-56 | 28.3 | 0.15 | 87 | 90 | 13 |
| Em-10 | SP-57 | 28.3 | 0.15 | 85 | 91 | 14 |
| Em-11 | SP-58 | 28.3 | 0.16 | 83 | 88 | 15 |
| Em-12 | SP-59 | 28.3 | 0.15 | 85 | 91 | 15 |
| Em-13 | SP-52 | 2.83 | 0.16 | 79 | 83 | 16 |
| Em-14 | SP-53 | 2.83 | 0.16 | 78 | 81 | 17 |
| Em-15 | SP-58 | 2.83 | 0.17 | 83 | 88 | 17 |
| Em-16 | SP-59 | 2.83 | 0.18 | 85 | 87 | 18 |

Growth of the Seed Emulsion of the Invention

In succession to the above, the silver halide emulsions each comprising tabular-shaped twinned crystal grains in the same seed emulsion growing process as in Example 1, except that the seed emulsions used in Example 1 were changed. After the resulting emulsions were desalted, emulsions EM-2 through EM-16 could be prepared, each having a pAg of 8.5 and a pH of 5.84 at a temperature of 40° C.

The resulting emulsions were observed through an electron microscope so as to obtain the average grain-size, the grain-size variation coefficient, the average grain-thickness, the proportion of the tabular-shaped grains having an aspect ratio of not less than 2 and the average aspect ratio of the grains having the aspect ratio of not less than 2.

The results thereof are shown in Table 2, together with the results obtained from comparative emulsion EM-1.

TABLE 2

| Emulsion | Average grain-size (μm) | Grain-size variation coefficient (%) | Average grain-thickness (μm) | Proportion of tabular grains having an aspect ratio ≧ 2 (%) | Average aspect ratio of tabular grains with an aspect ratio ≧ 2 (%) | Remarks |
|---|---|---|---|---|---|---|
| EM-1 | 1.40 | 19 | 0.35 | 86 | 4.0 | Comparison |
| EM-2 | 2.00 | 11 | 0.15 | 95 | 13.2 | Invention |
| EM-3 | 1.83 | 14 | 0.20 | 92 | 9.0 | Invention |
| EM-4 | 1.98 | 12 | 0.16 | 96 | 12.4 | Invention |
| EM-5 | 2.00 | 11 | 0.15 | 96 | 13.3 | Invention |
| EM-6 | 2.02 | 12 | 0.14 | 97 | 14.4 | Invention |
| EM-7 | 1.96 | 13 | 0.17 | 93 | 11.5 | Invention |
| EM-8 | 1.98 | 12 | 0.16 | 94 | 12.4 | Invention |
| EM-9 | 1.96 | 12 | 0.17 | 89 | 11.6 | Invention |
| EM-10 | 1.95 | 12 | 0.17 | 90 | 11.5 | Invention |
| EM-11 | 1.87 | 13 | 0.18 | 88 | 10.4 | Invention |
| EM-12 | 1.96 | 15 | 0.17 | 91 | 11.5 | Invention |
| EM-13 | 1.87 | 13 | 0.18 | 93 | 10.5 | Invention |
| EM-14 | 1.87 | 14 | 0.18 | 96 | 10.4 | Invention |
| EM-15 | 1.84 | 14 | 0.19 | 95 | 9.7 | Invention |
| EM-16 | 1.82 | 14 | 0.20 | 93 | 9.1 | Invention |

EXAMPLE 3 (Of The Invention)

Preparation of Seed Emulsions

Seed emulsions of the invention Em-17 through Em-25 were each prepared in the same manner as in Example 1, except that solutions $B_1$ and $C_1$ were added into solution $A_1$ in a double-jet method and, one minute after completing the addition, water-soluble synthetic polymers SP-6 and SP-60 through 63 were added thereto, respectively.

The above-mentioned water-soluble polymers were added in a prescribed amount of 750 ml in the form of an aqueous solutions, respectively.

When Em-17 through Em-25 were ripened, the KBr concentration, ammonia concentration and pH thereof were 0.026 mols/liter, 0.63 mols/liter and 11.3, respectively.

The resulting seed emulsions were observed through an electron microscope so as to obtain the average grain-size, the proportion of the seed grains each having {100} face, the proportion of the {100} face of the seed grains and the grain-size variation coefficient.

The results thereof are shown in Table 3, together with the results obtained from comparative seed emulsion Em-1.

TABLE 3

| Seed emulsion No. | Water-soluble polymer Kind | Amount added (g/mol of Ag) | Average grain-size (μm) | Proportion of seed grain having {100} faces (%) | Proportion of {100} faces of seed grain (%) | Grain-size variation coefficient (%) |
|---|---|---|---|---|---|---|
| Em-1 | — | — | 0.32 | — | — | 17 |
| Em-17 | SP-6 | 2.83 | 0.16 | 84 | 78 | 15 |
| Em-18 | SP-60 | 2.83 | 0.15 | 87 | 90 | 12 |
| Em-19 | SP-61 | 2.83 | 0.15 | 85 | 89 | 13 |
| Em-20 | SP-62 | 2.83 | 0.16 | 83 | 85 | 16 |
| Em-21 | SP-6 | 0.28 | 0.18 | 82 | 70 | 15 |
| Em-22 | SP-60 | 0.28 | 0.17 | 85 | 79 | 14 |
| Em-23 | SP-61 | 0.28 | 0.17 | 88 | 78 | 13 |
| Em-24 | SP-62 | 0.28 | 0.18 | 81 | 75 | 17 |
| Em-25 | SP-63 | 1.62 | 0.15 | 81 | 80 | 13 |

Growth of Seed Emulsions

In succession to the above, silver halide emulsions comprising tabular-shaped twinned crystal grains were each prepared in the same manner as in Example 1, except that the seed emulsions used in Example 1 were changed, respectively. After demineralizing and washing them, emulsion EM-17 through EM-25 were obtained, each having a pAg of 8.5 and a pH of 5.84 at a temperature of 40° C., respectively.

The resulting emulsions were observed through an electron microscope so as to obtain the average grain-size, the grain-size variation coefficient, the average grain-thickness, the proportion of the tabular-shaped grains having an aspect ratio of not less than 2 and the average aspect ratio of the grains having the aspect ratio of not less than 2.

The results thereof are shown in Table 4, together with the results obtained from comparative emulsion EM-1.

TABLE 4

| Emulsion | Average grain-size (μm) | Grain-size variation coefficient (%) | Average grain-thickness (μm) | Proportion of tabular grains having an aspect ratio ≧ 2 (%) | Average aspect ratio of tabular grains with an aspect ratio ≧ 2 (%) | Remarks |
|---|---|---|---|---|---|---|
| EM-1 | 1.40 | 19 | 0.35 | 86 | 4.0 | Comparison |
| EM-17 | 1.89 | 13 | 0.18 | 93 | 10.5 | Invention |
| EM-18 | 1.94 | 14 | 0.17 | 94 | 11.4 | Invention |
| EM-19 | 1.96 | 14 | 0.17 | 92 | 11.5 | Invention |
| EM-20 | 1.89 | 15 | 0.18 | 95 | 10.5 | Invention |
| Em-21 | 1.80 | 15 | 0.20 | 92 | 9.0 | Invention |
| EM-22 | 1.84 | 14 | 0.19 | 93 | 9.7 | Invention |
| EM-23 | 1.85 | 16 | 0.19 | 96 | 9.7 | Invention |
| EM-24 | 1.82 | 15 | 0.20 | 92 | 9.1 | Invention |
| EM-25 | 1.96 | 12 | 0.17 | 88 | 11.5 | Invention |

EXAMPLE 4 (Of The Invention)

Preparation of Seed Emulsions

Seed emulsions of the invention Em-26 through Em-35 were each prepared in the same manner as in Example 1, except that solutions $B_1$ and $C_1$ were added into solution $A_1$ in a double-jet method and, one minute after completing the addition, water-soluble synthetic polymers SP-4, 5, 8, 25, 26, 37 and 64 were added thereto, respectively.

The above-mentioned water-soluble polymers were added in a prescribed amount of 750 ml in the form of an aqueous solutions, respectively.

When Em-26 through Em-33 were ripened, the KBr concentration, ammonia concentration and pH thereof were 0.026 mols/liter, 0.63 mols/liter and 11.3, respectively.

The resulting seed emulsions were observed through an electronic microscope so as to obtain the average grain-size, the proportion of the seed grains each having {100} face, the proportion of the {100} face of the seed grains and the grain-size variation coefficient.

The results thereof are shown in Table 5, together with the results obtained from comparative seed emulsion Em-1.

TABLE 5

| Seed emulsion No. | Water-soluble polymer Kind | Amount added (g/mol of Ag) | Average grain-size (μm) | Proportion of seed grain having {100} faces (%) | Proportion of {100} faces of seed grain (%) | Grain-size variation coefficient (%) |
|---|---|---|---|---|---|---|
| Em-1 | — | — | 0.32 | — | — | 17 |
| Em-26 | SP-4 | 2.83 | 0.18 | 78 | 81 | 13 |
| Em-27 | SP-5 | 2.83 | 0.18 | 83 | 84 | 13 |

TABLE 5-continued

| Seed emulsion No. | Water-soluble polymer Kind | Amount added (g/mol of Ag) | Average grain-size (μm) | Proportion of seed grain having {100} faces (%) | Proportion of {100} faces of seed grain (%) | Grain-size variation coefficient (%) |
|---|---|---|---|---|---|---|
| Em-28 | SP-8 | 2.83 | 0.17 | 85 | 85 | 12 |
| Em-29 | SP-25 | 1.31 | 0.17 | 73 | 78 | 14 |
| Em-30 | SP-26 | 1.31 | 0.16 | 75 | 83 | 15 |
| Em-31 | SP-37 | 1.31 | 0.19 | 70 | 68 | 17 |
| Em-32 | SP-4 | 1.31 | 0.18 | 75 | 80 | 13 |
| Em-33 | SP-5 | 1.31 | 0.19 | 80 | 85 | 14 |
| Em-34 | SP-8 | 1.31 | 0.18 | 81 | 88 | 12 |
| Em-35 | SP-64 | 1.31 | 0.16 | 82 | 86 | 13 |

Growth of Seed Emulsions

In succession to the above, silver halide emulsions comprising tabular-shaped twinned crystal grains were each prepared in the same manner as in Example 1, except that the seed emulsions used in Example 1 were changed, respectively. After demineralizing and washing them, emulsion EM-26 through EM-35 were obtained, each having a pAg of 8.5 and a pH of 5.84 at a temperature of 40° C., respectively.

The resulting emulsions were observed through an electron microscope so as to obtain the average grain-size, the grain-size variation coefficient, the average grain-thickness, the proportion of the tabular-shaped grains having an aspect ratio of not less than 2 and the average aspect ratio of the grains having the aspect ratio of not less than 2, respectively.

The results thereof are shown in Table 6, together with the results obtained from comparative emulsion EM-1.

TABLE 6

| Emulsion | Average grain-size (μm) | Grain-size variation coefficient (%) | Average grain-thickness (μm) | Proportion of tabular grains having an aspect ratio ≧ 2 (%) | Average aspect ratio of tabular grains with an aspect ratio ≧ 2 (%) | Remarks |
|---|---|---|---|---|---|---|
| EM-1 | 1.40 | 19 | 0.35 | 86 | 4.0 | Comparison |
| EM-26 | 1.84 | 12 | 0.20 | 95 | 9.2 | Invention |
| EM-27 | 1.86 | 17 | 0.20 | 91 | 9.3 | Invention |
| EM-28 | 1.90 | 15 | 0.19 | 93 | 10.0 | Invention |
| EM-29 | 1.92 | 16 | 0.19 | 91 | 10.1 | Invention |
| EM-30 | 1.87 | 16 | 0.18 | 94 | 10.4 | Invention |
| EM-31 | 1.76 | 17 | 0.21 | 90 | 8.4 | Invention |
| EM-32 | 1.84 | 15 | 0.20 | 91 | 9.2 | Invention |
| EM-33 | 1.79 | 15 | 0.21 | 92 | 8.5 | Invention |
| EM-34 | 1.80 | 18 | 0.20 | 88 | 9.0 | Invention |
| EM-35 | 1.89 | 14 | 0.18 | 95 | 10.5 | Invention |

EXAMPLE 5 (Of The Invention)

Preparation of Seed Emulsions

Seed emulsions of the invention Em-36 through Em-45 were each prepared in the same manner as in Example 1, except that water-soluble synthetic polymers SP-1, 20, 52 through 55 and 61 through 64 were added into solution $A_1$ which was agitated at a high speed and then solutions $B_1$ and $C_1$ were each added thereinto in a double-jet method, respectively.

The above-mentioned water-soluble polymers were added in a prescribed amount of 750 ml in the form of an aqueous solutions, respectively.

The resulting seed emulsions were observed through an electron microscope so as to obtain the average grain-size, the proportion of the seed grains each having {100} face, the proportion of the {100} face of the seed grains and the grain-size variation coefficient.

The results thereof are shown in Table 7, together with the results obtained from comparative seed emulsion Em-1.

TABLE 7

| Seed emulsion No. | Water-soluble polymer Kind | Amount added (g/mol of Ag) | Average grain-size (μm) | Proportion of seed grain having {100} faces (%) | Proportion of {100} faces of seed grain (%) | Grain-size variation coefficient (%) |
|---|---|---|---|---|---|---|
| Em-1 | — | — | 0.32 | — | — | 17 |
| Em-36 | SP-1 | 26.7 | 0.22 | 71 | 73 | 15 |
| Em-37 | SP-20 | 26.7 | 0.23 | 67 | 69 | 15 |
| Em-38 | SP-52 | 26.7 | 0.20 | 73 | 69 | 13 |
| Em-39 | SP-53 | 26.7 | 0.21 | 72 | 70 | 15 |
| Em-40 | SP-54 | 26.7 | 0.19 | 70 | 67 | 18 |
| Em-41 | SP-55 | 26.7 | 0.20 | 74 | 67 | 16 |
| Em-42 | SP-61 | 26.7 | 0.23 | 69 | 58 | 17 |
| Em-43 | SP-62 | 26.7 | 0.24 | 65 | 66 | 17 |

TABLE 7-continued

| Seed emulsion No. | Water-soluble polymer Kind | Amount added (g/mol of Ag) | Average grain-size (μm) | Proportion of seed grain having {100} faces (%) | Proportion of {100} faces of seed grain (%) | Grain-size variation coefficient (%) |
|---|---|---|---|---|---|---|
| Em-44 | SP-63 | 26.7 | 0.22 | 67 | 60 | 16 |
| Em-45 | SP-64 | 26.7 | 0.22 | 70 | 62 | 18 |

Growth of Seed Emulsions

In succession to the above, silver halide emulsions comprising tabular-shaped twinned crystal grains were each prepared in the same manner as in Example 1, except that the seed emulsions used in Example 1 were changed, respectively. After demineralizing and washing them, emulsion EM-36 through EM-45 were obtained, each having a pAg of 8.5 and a pH of 5.84 at a temperature of 40° C., respectively.

The resulting emulsions were observed through an electron microscope so as to obtain the average grain-size, the grain-size variation coefficient, the average grain thickness, the proportion of the tabular-shaped grains having an aspect ratio of not less than 2 and the average aspect ratio of the grains having the aspect ratio of not less than 2, respectively.

The results thereof are shown in Table 8, together with the results obtained from comparative emulsion EM-1.

TABLE 8

| Emulsion | Average grain-size (μm) | Grain-size variation coefficient (%) | Average grain-thickness (μm) | Proportion of tabular grains having an aspect ratio ≧ 2 (%) | Average aspect ratio of tabular grains with an aspect ratio ≧ 2 (%) | Remarks |
|---|---|---|---|---|---|---|
| EM-1 | 1.40 | 19 | 0.35 | 86 | 4.0 | Comparison |
| EM-36 | 1.72 | 19 | 0.24 | 89 | 7.2 | Invention |
| EM-37 | 1.70 | 17 | 0.25 | 87 | 6.8 | Invention |
| EM-38 | 1.77 | 17 | 0.21 | 90 | 8.4 | Invention |
| EM-39 | 1.74 | 18 | 0.23 | 87 | 7.6 | Invention |
| EM-40 | 1.81 | 19 | 0.20 | 87 | 9.1 | Invention |
| EM-41 | 1.78 | 17 | 0.21 | 91 | 8.5 | Invention |
| EM-42 | 1.60 | 16 | 0.25 | 90 | 6.4 | Invention |
| EM-43 | 1.60 | 17 | 0.26 | 89 | 6.2 | Invention |
| EM-44 | 1.72 | 17 | 0.24 | 86 | 7.2 | Invention |
| EM-45 | 1.73 | 18 | 0.24 | 88 | 7.2 | Invention |

In the seed emulsions of the invention Em-2 through Em-45 which were given in Examples 2 through 5, any coalescence phenomena cannot be produced between the grains thereof, but small-sized monodisperse type twinned crystal seed grains can be obtained and, in addition, the emulsions processed through the seed emulsion growing step are proved to be monodisperse type twinned crystal silver halide emulsion having a high aspect ratio.

In the invention, a silver halide seed emulsion could be provided without making use of any low-molecular weight gelatin so that the grain-size thereof can be made smaller such as 0.3 to 3.0 μm and a monodisperse type twinned crystal silver halide emulsion having a high aspect ratio can suitably be prepared.

What is claimed is:

1. A method of preparing a silver halide photographic emulsion containing silver halide twinned-crystal grains comprising, in sequence, the steps of (a) forming silver halide nuclear grains by mixing a water soluble silver salt and a water soluble halide, (b) forming silver halide seed-emulsion grains by carrying out ripening of said nuclear grains formed in (a), and (c) growing said seed-emulsion grains, wherein a water soluble polymer is introduced in (b), wherein said water soluble polymer has the repetition unit represented by the following formula [P] in an amount of 10 to 100 mol % per each polymer molecule:

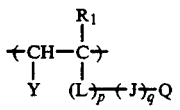

formula [P]

wherein $R_1$ represents a hydrogen atom, a halogen atom, an alkyl group or —$CH_2COOM$, in which M represents a hydrogen atom or an alkali metal atom; L represents —CONH—, —NHCO—, —COO—, —OCO—, —CO— or —O—; J represents an alkylene group, an arylene group or —$(CH_2CH_2O)_m(CH_2)_n$—, in which m is an integer of 0 to 40 and n is an integer of 0 to 4; and Q represents a hydrogen atom, $R_3$or at least one of the following groups:

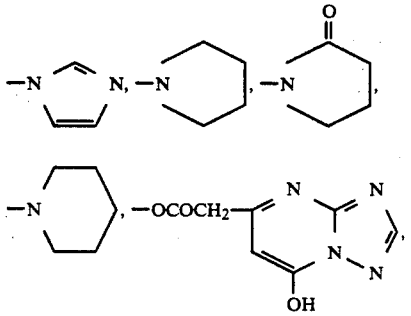

-continued

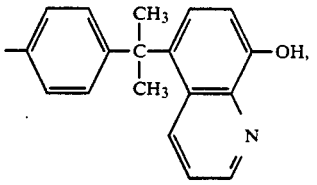

$-N^{\oplus}(R_4)(R_5)(R_6)X^{\ominus}$, $-N(R_7)(R_8)$, $-OM$, $-NH_2$, $-SO_3M$, $-O-P(=O)(OM_2$, $-C(=O)R_2$, wherein M represents a hydrogen atom or a cation; $R_2$, $R_3$, $R_4$, $R_5$, $R_6$, $R_7$ and $R_8$ each represents an alkyl group; X represents an anion; Y represents a hydrogen atom or a carboxyl group; p and q each are an integer of 0 or 1.

2. The method of claim 1, wherein said water soluble polymer is introduced in an amount of $1\times10^{-4}$ to $3\times10^{2}$ g/mol of silver halide.

3. The method of claim 1, wherein in (b) a silver halide solvent is added in an amount of $1\times10^{-5}$ to 2.0 mol/mol of silver halide.

4. The method of claim 3, wherein said silver halide solvent is a combination of a water soluble bromide and ammonia.

5. The method of claim 1, wherein said silver halide emulsion contains silver halide twinned-crystal grains having an aspect ratio of diameter to thickness of not less than 2 in an amount of not less than 60% by number of grains.

6. The method of claim 5, wherein said silver haide grains having aspect ratio of not less than 2 have an average aspect ratio of 5 to 60.

7. The method of claim 1, wherein said siver halide grains are monodispersed, having a variation coefficient of not more than 20%.

8. The method of claim 3, wherein said silver halide grains comprise silver iodobromide or silver iodochlorobromide.

9. The method of claim 1, wherein said seed-emulsion grains comprise {100} crystal face.

* * * * *